United States Patent [19]

Reid

[11] Patent Number: 5,052,485

[45] Date of Patent: Oct. 1, 1991

[54] JAR MECHANISM

[75] Inventor: Michael A. Reid, Aberdeen, Scotland

[73] Assignee: Well-Equip Limited, Dyce, United Kingdom

[21] Appl. No.: 542,164

[22] Filed: Jun. 22, 1990

[30] Foreign Application Priority Data

Jun. 29, 1989 [GB] United Kingdom ..... 8914932[U]
Feb. 14, 1990 [GB] United Kingdom ..... 9003372

[51] Int. Cl.[5] ..... E21B 31/113

[52] U.S. Cl. ..... 166/178; 175/297; 175/299

[58] Field of Search ..... 166/178, 301; 175/297, 175/299, 300, 302, 304

[56] References Cited

U.S. PATENT DOCUMENTS

| | | | |
|---|---|---|---|
| 3,949,821 | 4/1976 | Raugust | 175/297 |
| 4,007,798 | 2/1977 | Gazda | 175/297 |
| 4,142,597 | 3/1979 | Johnston | 175/304 |
| 4,181,186 | 1/1980 | Blanton | 175/297 |
| 4,230,197 | 10/1980 | Wenzel | 175/297 |
| 4,478,284 | 10/1984 | Tomm et al. | 175/297 |

FOREIGN PATENT DOCUMENTS

| | | |
|---|---|---|
| 0147154 | 7/1985 | European Pat. Off. . |
| 2194573 | 3/1988 | United Kingdom . |

*Primary Examiner*—Terry L. Melius

[57] ABSTRACT

A jar mechanism is described, which comprises a piston (5) movably mounted in a fluid chamber (9). A jar member (2) is releasably coupled to the piston (5) by a release device (3, 4; 3, 38, 39, 40, 54, 64) so that when the piston (5) is in a first position in the fluid chamber (9), the jar member (2) is coupled to the piston (5) by the release device (3, 4; 3, 38, 39, 40, 54, 64). A first force exerted on the jar member (2) moves the piston (5) to a second position within the fluid chamber (9) against the resistance of the fluid (11). When the piston (5) is in the second position, the action of the first force applied to the jar member (2) actuates the release device (3, 4; 3, 38, 39, 40, 54, 64) to enable the jar member (2) to be uncoupled from the piston (5).

10 Claims, 7 Drawing Sheets

JAR MECHANISM

The invention relates to jar mechanisms and, in particular, a jar mechanism for an upstroke jar.

BACKGROUND OF THE INVENTION

Wireline is a method of lowering specialised equipment into an oil or gas well, or raising specialised equipment from an oil or gas well. The principle of wireline is to attach a workstring or toolstring to the end of a reel of wire and by reeling out the wire the toolstring is lowered into the well. By either reeling in or reeling out the wire, the toolstring can be made to perform simple tasks downhole.

The toolstring consists of a variable combination of individual tools screwed together to form a working unit. A toolstring typically comprises a rope socket, a stem or sinker bar, an upstroke jar, a spang jar and a pulling and running tool. The rope socket attaches the toolstring to the wire. The stem or sinker bar comprises lengths of bars screwed together to give the toolstring weight and also provides a mass for jarring operations. The upstroke jar is a mechanical or hydraulically operated device which allows a delayed partial release of the upper portion of the toolstring to enable an upwardly directed high impact force to be generated by the toolstring. The spang jar is a very simple device and similar to an elongated chain link and allows immediate movement of the upper portion of the toolstring. Spang jars are used to allow upward or downward impact forces to be generated by the toolstring. At the end of the toolstring there are pulling tools and running tools. These various tools are available to be screwed directly to the end of the toolstring. These are used for either pulling equipment out of the well or setting and leaving equipment in the well.

Conventionally, there are two distinct types of upstroke jar available on the market. The first is a hydraulic jar and the second is a mechanical or spring jar. Both types of jar have different attributes and disadvantages.

The hydraulic jar is activated only when the bottom end of the jar is anchored and the top end is subjected to a constant pulling force. For simplicity the jar can be regarded as being a piston located in a cylinder which is filled with hydraulic oil. The piston, commonly known as the jar rod, is normally at the bottom end of its stroke within the cylinder, where the two are close fitting. Very limited fluid by-pass around the piston means that it takes considerable force and time to move the piston up the cylinder. The time factor allows a desired pull force to be reached before the piston reaches the point where the internal diameter of the cylinder opens out. When the piston reaches the opened out portion of the cylinder, the pulling force accelerates the piston to the top of its stroke where it will deliver an impact force upwardly when it is stopped by the jar housing itself. The piston usually contains a small check valve to enable a fast return stroke into the small internal diameter portion of the cylinder by allowing greater fluid by-pass in that direction only.

The advantages of hydraulic jars are that they are very versatile in use because a small pulling force will result in a small jar force and similarly a large pulling force will result in a large jar force. In addition, there is no need to remove these jars from the toolstring to adjust the release setting, as is necessary with mechanical jars. Hydraulic jars will also fire whatever the value of the pulling force that is used or is available.

However, hydraulic jars still have a number of disadvantages. As there is a seal around the jar rod itself, the ability of the jar to function depends on the life time of this seal. This seal is subjected to considerable wear and tear due to the violent motion of the jar rod. To ensure relocation of the piston back into the lower reduced internal diameter the jar rod is usually fairly short and this compromises the resulting jarring force available. Also, the whole tool is full of hydraulic oil which makes maintenance of the tool difficult.

Mechanical jars contain no hydraulic oil. The jar therefore has no seals. Again the jar can be regarded as a piston within a cylinder however this time the piston is held at the bottom end of its stroke by various mechanical mechanisms which are usually dependent on the manufacturers. Usually the mechanism comprises a coil spring or spring washer stack arrangement as part of the mechanism. The spring is used to pull against to allow the piston to be released and travel up its full stroke within the main housing of the jar when a certain known pull force is reached. This value is usually dependent on the spring rate.

The advantages of the mechanical jar are that there is no seal around the jar rod and there is an unhindered travel of the jar rod up to its full stroke, i.e. there is no hydraulic oil to be by-passed. It is also possible to obtain a larger jar rod stroke than can be achieved with a hydraulic jar.

However, there are also a number of disadvantages associated with mechanical jars. Mechanical jars must be removed from the toolstring in order to be adjusted to the desired pull force for activation downhole and the pull force at which the jar is set to fire must be applied to the jar before the jar will work. This value is often difficult to predict especially when it is used deep downhole. There is also a difficulty in maintenance due to the large number of parts which comprise the jar.

Coil tubing operations are similar to wireline operation and also use jar mechanisms to enable high impact forces to be generated by the toolstring during the coil tubing operation. However, with coil tubing operations there is the additional complexity that it is desirable to pump fluid through the toolstring during the operations, and this feature has been difficult to combine with conventional jar mechanisms.

SUMMARY OF THE INVENTION

In accordance with the present invention a jar mechanism comprises a piston movably mounted in a fluid chamber; a jar member releasably coupled to the piston by a release device such that when the piston is in a first position in the fluid chamber, the jar member is coupled to the piston by the release device for movement therewith and whereby a first force exerted on the jar member moves the piston to a second position within the fluid chamber against the resistance of the fluid, whereby the action of the first force applied to the jar member actuates the release device to enable the jar member to be uncoupled from the piston.

The invention mitigates the problems of the prior art jar mechanisms by combining a jar member which is releasably secured to a piston with a fluid chamber in which the piston is mounted so that the jar member is not in contact with the fluid..

Preferably, the piston includes a one way valve which closes and prevents fluid flow through the piston when the piston moves from the first to the second position, but which opens and allows fluid to flow through the piston when the piston moves from the second to the first position. In one example, the one way valve comprises a chamber which communicates with the fluid on either side of the piston and inside the chamber is located a spherical member such as a ballbearing which prevents fluid passing through the chamber when the piston moves from the first position to the second position, but which permits fluid to pass through the chamber when the piston moves from the second position to the first position.

In another example, the one way valve comprises at least one fluid channel which communicates with the fluid on one side of the piston and an annular sleeve movable between a first position, in which the at least one fluid channel is prevented from communicating with the other side of the piston, and a second position in which the at least one fluid channel communicates with the other side of the piston, to enable fluid to pass from the one side of the piston to the other side of the piston. Typically, the external surface of the annular sleeve forms the surface of the piston which abuts against the surface of the fluid chamber.

Preferably, in the second example of the one way valve there are four fluid channels.

Preferably, the release device is movably mounted on the piston for movement between an engagement position and a release position and the release device is typically biased to an intermediate position, between the engagement and the release positions, and whereby the jar member may be uncoupled from the piston when the release device is in the release position and the piston is in the second position and whereby the jar member may be recoupled to the piston when the release device is in the engagement position and the piston is in the first position.

Typically, the release device moves to the intermediate position when the jar member is uncoupled from the piston.

Typically, the release device is biased to the intermediate position by a spring, such as a helical spring.

Preferably, when a force opposite to the first force is applied to the jar member, the jar member causes the release device to move to the engagement position and the piston is moved from the second to the first position so that the release device couples the piston to the jar member.

Alternatively, the jar mechanism may comprise means to retain the piston in the second position when the jar member is uncoupled from the piston. In this example the means to maintain the piston in the second position comprises a biasing means such as a helical spring.

Typically, the jar mechanism may be used as a wireline jar for wireline operations, or as a pump through jar for coil tubing operations in a borehole.

BRIEF DESCRIPTION OF THE DRAWINGS

An example of a jar mechanism in accordance with the invention will now be described with reference to the accompanying drawings, in which.

DESCRIPTION OF PREFERRED EMBODIMENTS

Figure 1:
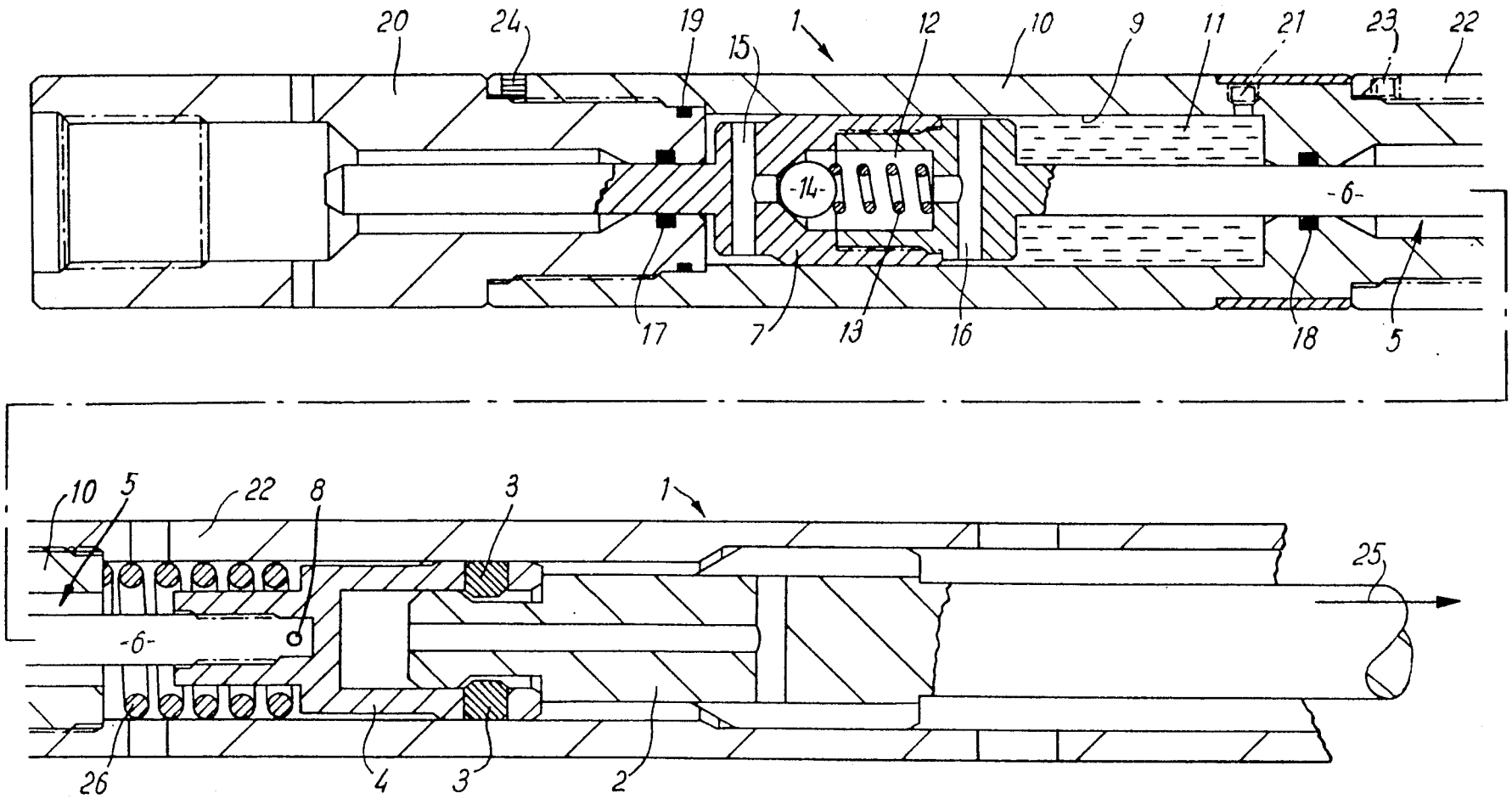
FIG. 1 is a cross sectional view of a first example of an upstroke jar showing the jar mechanism in the primed position.

FIG. 1 shows an upstroke jar 1 for use in wireline operations which comprises a jar rod 2 which is releasably secured via a latch key 3 and a latch sub 4 to a piston 5. The piston 5 comprises a piston top 6 and a piston body 7 and the latch sub 4 is secured to the piston top 6 by means of a roll pin 8.

The piston top 6 and the piston body 7 are secured together within a fluid chamber 9 located in a piston housing 10. The fluid chamber 9 contains a fluid 11, such as hydraulic oil although any other suitable gas or liquid could be used. The piston 5 comprises a chamber 12 within which is located a one way valve which comprises a helical spring 13 and a ball 14. Fluid may enter into the chamber 12 via the two passage ways 15, 16 on either side of the piston 5 and which communicate with the fluid chamber 9 and the internal piston chamber 12.

There are also three O ring seals 17, 18, 19 which prevent leakage of the fluid 11 from the fluid chamber 9. The O ring seal 17 prevents leakage of fluid 11 between the shaft of the body portion 7 of the piston 5 and a bottom sub 20. The O ring seal 18 prevents leakage of the fluid 11 between the piston housing 10 and the shaft of the piston top 6 and the O-ring seal 19 prevents leakage of the fluid 11 from between the piston housing 10 and the bottom sub 20.

A bleed screw 21 is located in the piston housing 10 and this is used to prevent an air lock forming in the fluid chamber 11 when the jar 1 is being assembled. The jar 1 also comprises a main body housing 22 which is attached to the piston housing 10 by means of a locking screw 23. The bottom sub 20 is connected to the piston housing 10 by a locking screw 24.

When an upward jarring force is to be exerted by the jar 1 the jar rod 2 is pulled in the direction shown by the arrow 25 in FIG. 1. The pulling force exerted on the jar rod 2 is transmitted to the piston via the latch key 3 and the latch sub 4 so that the piston 5 is moved through the fluid chamber 9 against the resistance of the fluid 11. This is achieved by the restricted by-pass of the fluid 11 between the piston body 7 and the piston housing 10 and by preventing fluid passing through the passage ways 15, 16 and chamber 12 in the piston 5 by blocking the passage way 15 with the ball 14.

Figure 2:
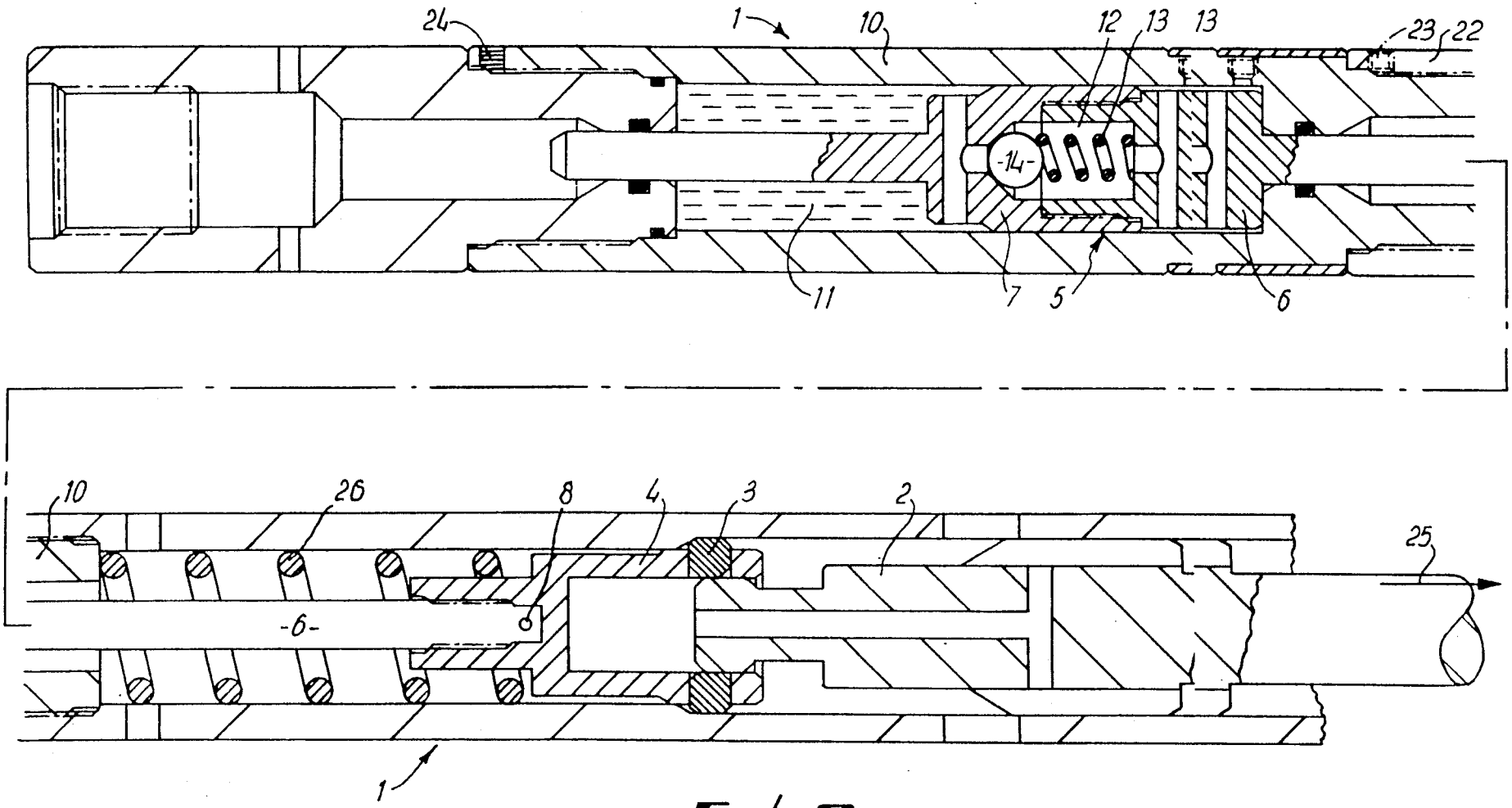
FIG. 2 is a cross sectional view similar to FIG. 1 but with the mechanism at the point at which the jar rod is released.

As the movement of the piston 5 and the jar rod 2 is slow due to restricted fluid by-pass, time is available to pull up to a desired pull force before the piston 5 reaches the other end of the fluid chamber 9. This position is shown in FIG. 2 and at this point continuation of the pulling force in the direction of the arrow 25 on the jar rod 2 forces the latch key 3 out of engagement with the jar rod 2 and into engagement with the main housing 22 so that the jar rod 2 is released from the piston 5 and rapidly accelerates in the direction of the arrow 25 until it hits the top end (not shown) of the main body housing 22. When this occurs an upward jarring force is exerted on the toolstring to which the jar 1 is attached.

Figure 3:
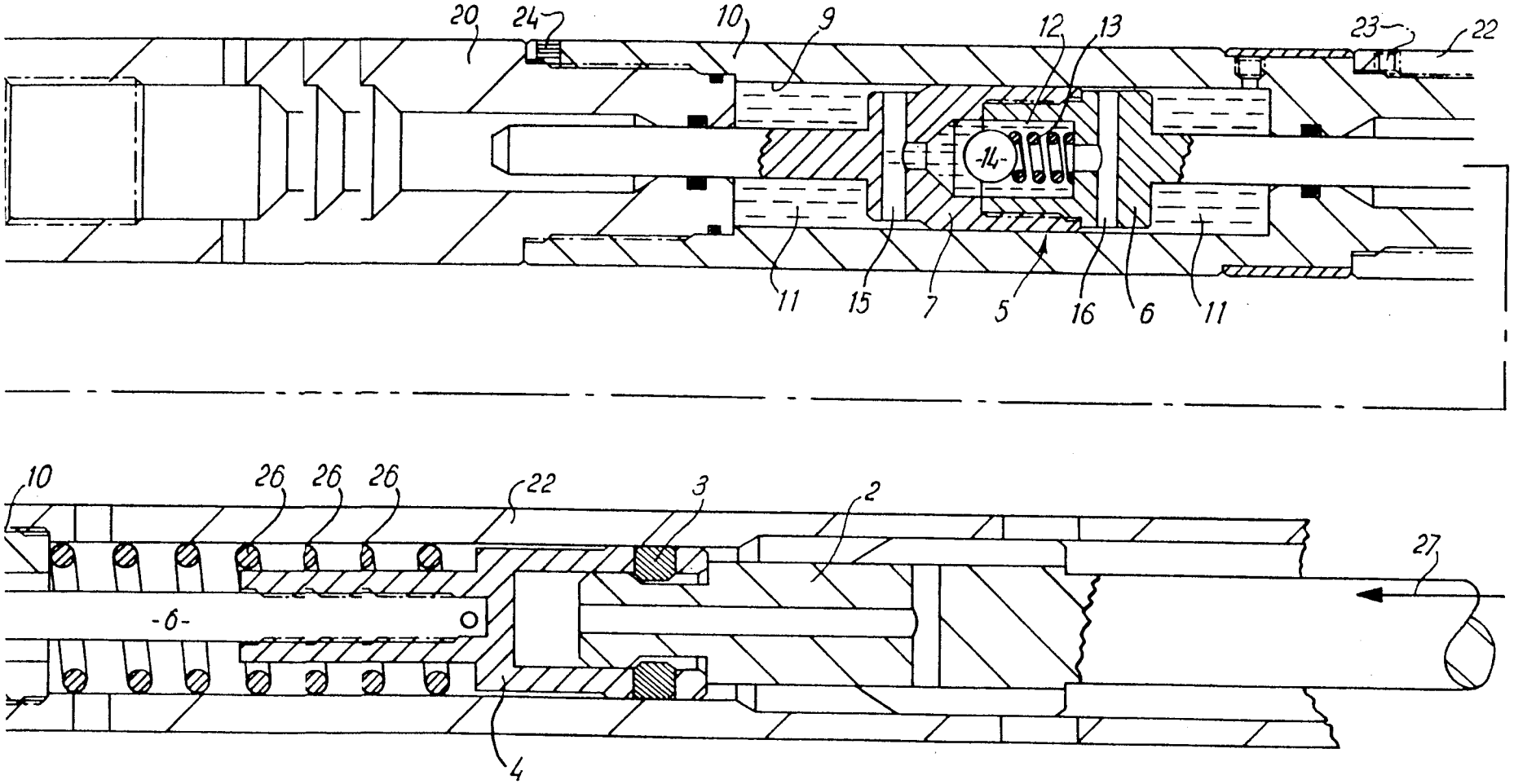
FIG. 3 is a cross sectional view similar to FIGS. 1 and 2 but with the mechanism at an intermediate position during re-priming of the mechanism.

After the jarring force has been produced the jar rod 2 is returned to the latch sub 4 by application of a downward force to the jar rod 2 in the direction shown by the arrow 27 in FIG. 3. The latch sub 4, the latch key 3 and the piston 5 are maintained in the release position by means of helical spring 26 which enables the jar rod 2 to be inserted back into the latch sub 4.

Continued application of the downward force in the direction of the arrow 27, as shown in FIG. 3, forces the latch key 3 to re-engage with the jar rod 2 and forces the piston 5 to return to the primed position against the action of the helical spring 26.

When the piston 5 is being returned to the primed position the force of the fluid entering into the passage way 15 in the piston body 7 forces the ball 14 against the action of the spring 13 into the middle of the chamber 12 so that fluid may pass through the chamber 12 into the passage way 16 and into the chamber 9 on the other side of the piston 5. Hence, the ball 14 and spring 13 act as a one way valve so that the resistance against movement of the piston is high when the piston moves from the primed position to the unprimed position but is very low when the piston moves from the unprimed position to the primed position. This enables the piston 5 to be easily returned to the primed position after the jarring force has been produced.

In addition, the seals 17, 18 are of the same dimensions and this allows the pressure around the piston housing 10 to be balanced at all times.

By constructing the jar mechanism so that the jar rod 2 and the piston 5 are separable mitigates the disadvantages of conventional jar mechanisms by locating the fluid 11 only in the vicinity of the piston and avoiding the need for fluid seals around the jar rod 2. This configuration also avoids the disadvantages of a mechanical jar as it is not necessary to remove the toolstring from the borehole in order to adjust the jarring force. The jarring force exerted by the jar rod 2 is dependent on the force with which the jar rod and piston 5 are pulled from the first position to the second position and therefore is only dependent on the maximum pulling force available on site at the oilfield.

Figure 4:
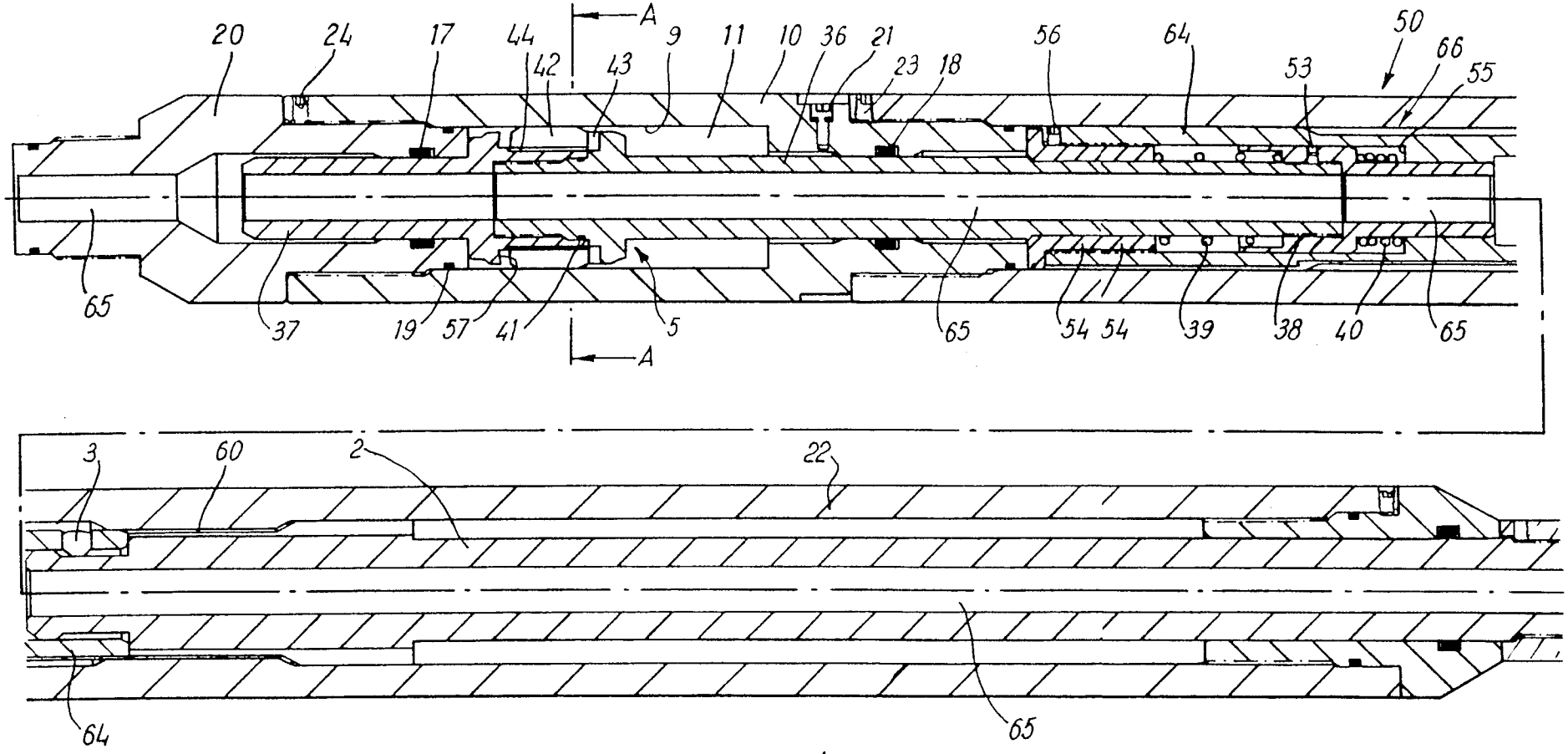
FIG. 4 is a cross sectional view of a second example of an upstroke jar.

FIG. 4 shows an example of an upstroke jar for use in coil tubing operations. The upstroke jar 50 works in a similar manner to the upstroke jar 1 and the parts of the upstroke jar 50 which are similar to the upstroke jar 1, shown in FIGS. 1 to 3 have the same reference numerals.

However, the upstroke jar 50 has a bore 65 through its entire length which enables fluid to be pumped through the jar 50 so that the jar may be used in coil tubing operations.

Figure 5:
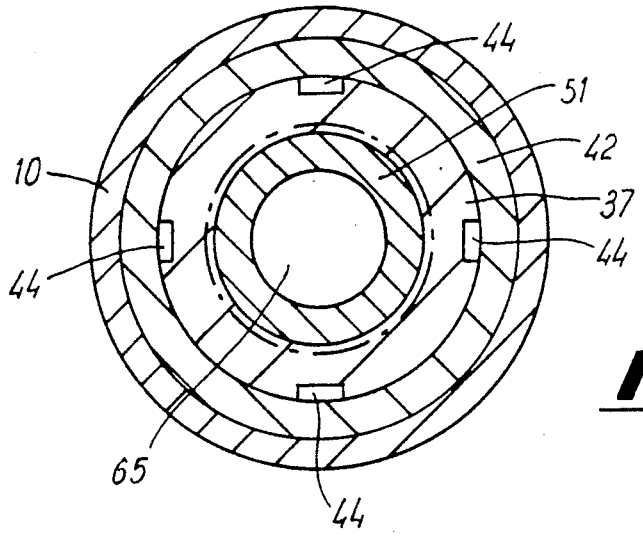
FIG. 5 is a cross sectional view along the line A—A in FIG. 4.
Figure 7:
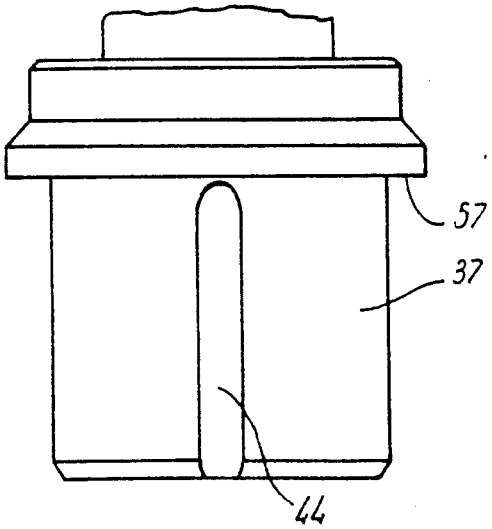
FIG. 7 shows a second portion of a piston for use in the upstroke jar shown in FIG. 4; and, FIGS. 8A to 8D are schematic diagrams showing the sequence of positions for a release device for use in the upstroke jar shown in FIG. 4.

Another difference between the upstroke jar 50 and the upstroke jar 1 is the design of the piston 5. In the upstroke jar 50 the piston 5 comprises two piston sections 36, 37 and a by-pass sleeve 42. The piston section 37 has four channels 44 equidistantly spaced around the external surface of the portion of the piston section 37 on which the by-pass sleeve 42 is located. The channels 44 are shown in more detail in FIGS. 5 and 7.

Figure 6:
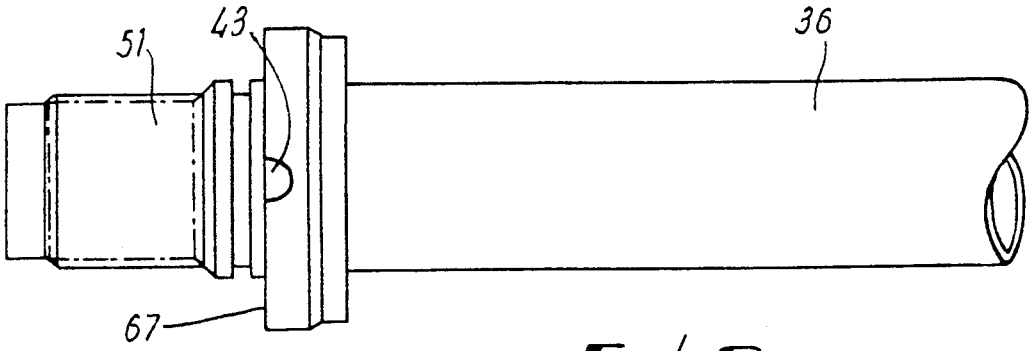
FIG. 6 shows a first portion of a piston for use in the upstroke jar shown in FIG. 4.

The piston section 36 also has four channels 43 which coincide with the channels 44 in the piston section 37. The channels 43 are shown in more detail in FIG. 6. The threaded male portion 51 of the piston 36 is screwed into the threaded female portion 52 of the piston section 37, so that the channels 43, 44 are coincident with each other.

Figure 8A:
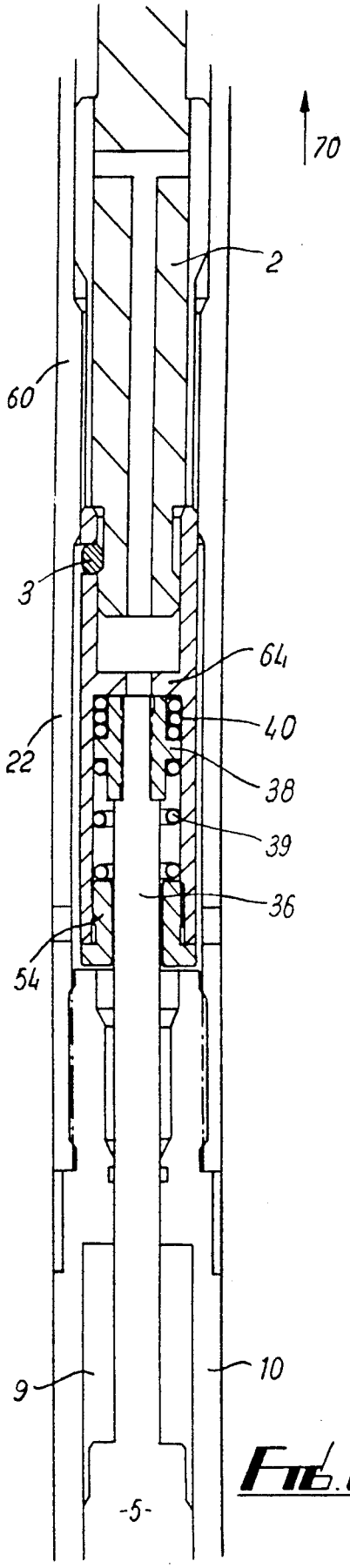

The upstroke jar 50 also has a modified release and re-engagement mechanism 66 for connecting the piston 5 to the jar rod 2. In the upstroke jar 50 this mechanism 66, shown schematically in FIG. 8A, comprises a latch housing 64 within which is slidably mounted the piston section 36 which is attached to a spring bush 38 and locked onto the retainer 38 by a locking screw 53. The latch housing 64 is threaded onto a spring retainer 54 and held in position by a locking screw 56. A helical spring 40 is located between the spring bush 38 and a shoulder 55 of the latch housing 4, and a second helical spring 39 is located on the other side of the spring bush 38 between the spring bush 38 and the spring retainer 54.

Figure 8B:
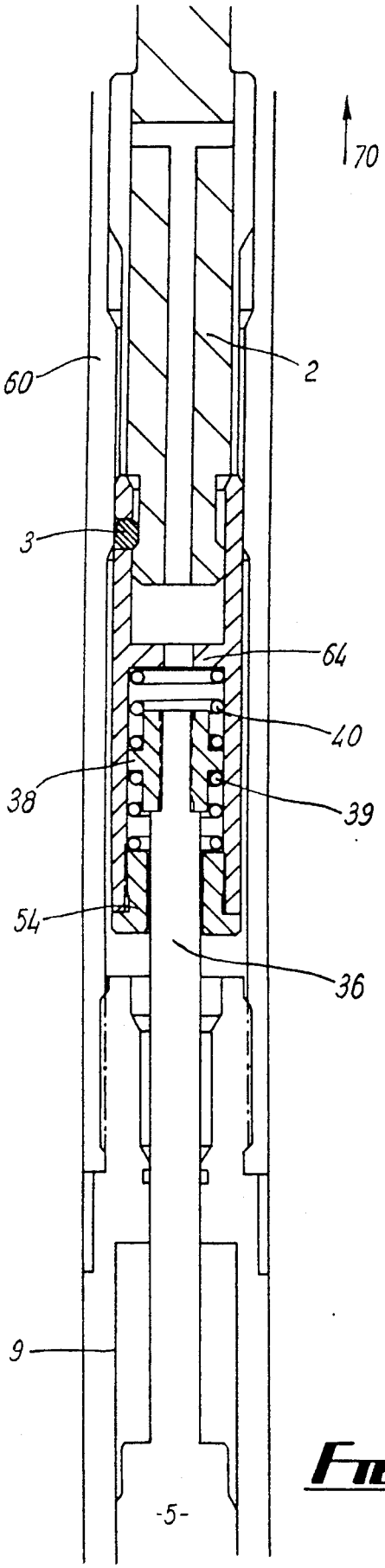

In use, when a force is applied to the jar rod 2 of the upstroke jar 50 in the direction shown by the arrow 70, the pressure exerted by the jar rod 2 is released from the latch housing 64. This allows the spring 40 to expand and push the latch housing 64 and the spring retainer 54 to the position shown in FIG. 8B while the piston 5 and the spring bush 38 remain static relative to the main body housing 22 and the piston housing 10. As the jar rod 2 is pulled further in the direction of the arrow 70, the spring 39 is compressed by the spring retainer 54 and the piston 5 is pulled along the piston chamber 9. As the piston 5 is pulled along the piston chamber 9 the movable by-pass sleeve 42 is forced against the shoulder 57 of the piston section 37 which prevents fluid in the piston chamber 9 flowing through the channels 43, 44 to the other side of the piston. Hence, a large force is required on the jar rod 2 to move the piston 5 from one end to the other end of the piston chamber 9.

Figure 8C:
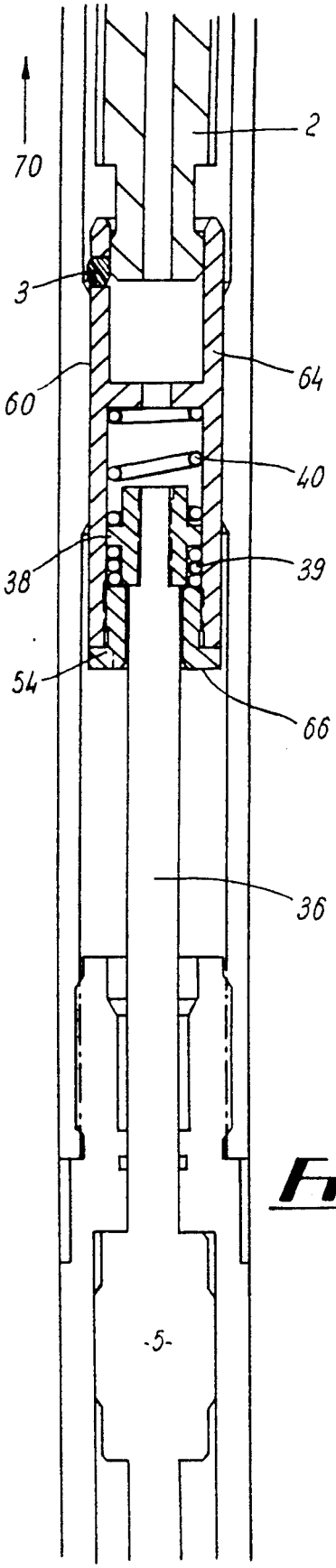

When the piston 5 reaches the other end of the piston chamber 9 the latch housing 4 is in the position shown in FIG. 8C and the force exerted by the jar rod 2 pushes the latch key 3 out of engagement with the jar rod 2 to enable the jar rod 2 to be released from the housing 4. This causes the jar rod 2 to move rapidly upwards to exert an upward impact force on the top of the upstroke jar (not shown).

Figure 8D:
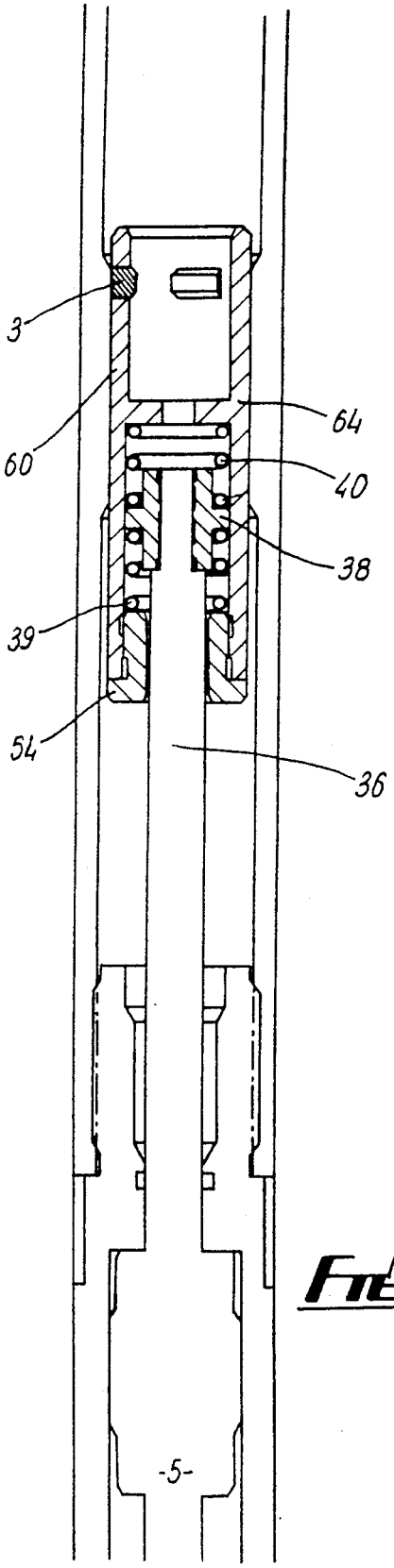

After the jar rod 2 has been released, the latch housing 4 moves to the position shown in FIG. 8D due to the biasing action of the helical spring 39 against the spring retainer 34 and the latch keys 3 are within the reduced diameter section 60 of the main housing 22.

To re-latch the jar rod 2 with the latch housing 4, the jar rod 2 is pushed against the latch key 3 and the latch housing 4, and this causes the latch housing 4 and the spring retainer 54 to move relative to the piston 5 and the spring bush 38 which causes the helical spring 40 to compress. This compression exerts a force on the piston 5, via the spring bush 38 which urges the piston 5 towards its initial position. As the piston moves towards its initial position the shoulder 67 on the piston section 36 abuts against the by-pass sleeve 42 so that the channels 44, 43 communicate with both sides of the fluid chamber 9 and fluid may pass from one side of the fluid chamber to the other side via the channel 44 and the channel 43. Hence, there is very little resistance to movement of the piston 5 as it returns to its initial position. When the piston 5 returns to its initial position the piston 5 and the spring bush 38 stop moving relative to the piston housing 10 and the main body housing 22 but the force exerted by the jar rod 2 on the latch housing 4 causes the latch housing 4 to move to the position shown in FIG. 8A and the latch keys 3 move out of the reduced diameter section 60 of the main body housing 22 so that the jar rod 2 may re-engage with the latch housing 4 and the latch keys 3, as shown in FIG. 4.

Both the piston assembly 5 and the engagement and release mechanism as described above for the upward jar 50 could of course be used in an ordinary wireline jar and in fact the wireline upstroke jar 1 performs better when the release and engagement mechanism 66 is used instead of the simple release mechanism shown in FIGS. 1 to 3.

Modifications and improvements may be incorporated without departing from the scope of the invention.

I claim:

1. A jar mechanism comprising:

a housing having an impact surface;

a fluid chamber located within said housing and containing a fluid;

a piston movably mounted in said fluid chamber, said piston being movable within said fluid chamber between a first position and a second position;

a jar member movably mounted within said housing; and a release device releasably coupling said jar member to said piston such that when said piston is in said first position in said fluid chamber, said jar member is coupled to said piston by said release device for movement therewith;

and whereby a first force exerted on said jar member moves said piston to said second position within said fluid chamber against the resistance of said fluid, whereby the action of said first force applied to said jar member, when the piston is in said second position, actuates said release device to release said jar member from said piston and said first force accelerates said jar member relative to said housing and said piston so that said jar member impacts against said impact surface to create a jarring force.

2. A jar mechanism according to claim 1, wherein said piston includes a one-way valve which closes and prevents said fluid flowing through said piston when said piston moves from said first to said second position, but which opens and allows said fluid to flow through said piston when said piston moves from said second to said first position.

3. A jar mechanism according to claim 2, wherein said one-way valve comprises a chamber which communicates with said fluid on either side of said piston and a valve member located inside said chamber, which prevents said fluid passing through said chamber when said piston moves from said first position to said second position, but which permits said fluid to pass through said chamber when said piston moves from said second position to said first position.

4. A jar mechanism according to claim 3, wherein said valve member is spherical.

5. A jar mechanism according to claim 2, wherein said one-way valve comprises at least one fluid channel which communicates with said fluid on one side of said piston and an annular sleeve movable between a first position, in which said at least one fluid channel is prevented from communicating with the other side of said piston, and a second position in which said at least one fluid channel communicates with said other side of said piston to enable fluid to pass from said one side of said piston to said other side of said piston.

6. A jar mechanism according to claim 5, wherein said annular sleeve forms the surface of said piston which abuts against the surface of said fluid chamber.

7. A jar mechanism according to claim 1, wherein said release device is movably mounted on said piston for movement between an engagement position and a release position.

8. A jar mechanism according to claim 7, wherein said release device is biased to an intermediate position between said engagement position and said release position.

9. A jar device for use in wireline operations comprising a jar mechanism which comprises a housing having an impact surface;

a fluid chamber located within said housing and containing a fluid;

a piston movably mounted in said fluid chamber, said piston being movable within said fluid chamber between a first position and a second position;

a jar member movably mounted within said housing; and a release device releasably coupling said jar member to said piston such that when said piston is in said first position in said fluid chamber, said jar member is coupled to said piston by said release device for movement therewith;

and whereby a first force exerted on said jar member moves said piston to said second position within said fluid chamber against the resistance of said fluid, whereby the action of said first force applied to said jar member, when the piston is in said second position, actuates said release device to release said jar member from said piston and said first force accelerates said jar member relative to said housing and said piston so that said jar member impacts against said impact surface to create a jarring force and wherein said jar device includes a means for coupling to said wire line.

10. A jar device for coil tubing operations comprising a jar mechanism which comprises a housing having an impact surface;

a fluid chamber located within said housing and containing a fluid;

a piston movably mounted in said fluid chamber, said piston being movable within said fluid chamber between a first position and a second position;

a jar member movably mounted within said housing; and a release device releasably coupling said jar member is said piston such that when said piston is in said first position in said fluid chamber, said jar member is coupled to said piston by said release device for movement therewith;

and whereby a first force exerted on said jar member moves said piston to said second position within said fluid chamber against the resistance of said fluid, whereby the action of said first force applied to said jar member, when the piston is in said second position, actuates said release device to release said jar member from said piston and said first force accelerates said jar member to relative to said housing and said piston so that said jar member impacts against said impact surface to create a jarring force and wherein said jar mechanism includes a fluid channel which extends along the axial length of said jar mechanism to enable a fluid to be pumped through said jar mechanism from said coil tubing.

* * * * *